United States Patent [19]

Lehman

[11] Patent Number: 5,076,032

[45] Date of Patent: Dec. 31, 1991

[54] POST AND ANCHORING DEVICE

[75] Inventor: John F. Lehman, Canfield, Ohio

[73] Assignee: Steel City Corporation, Youngstown, Ohio

[21] Appl. No.: 579,946

[22] Filed: Sep. 10, 1990

[51] Int. Cl.[5] ..... E02D 27/42

[52] U.S. Cl. ..... 52/169.13; 52/165; 52/292; 248/156; 248/530

[58] Field of Search ..... 52/155, 165, 166, 105, 52/292, 169.13; 248/545, 156, 530, 532, 533, 508

[56] References Cited

U.S. PATENT DOCUMENTS

| | | | |
|---|---|---|---|
| 427,815 | 5/1890 | Wolf . | |
| 844,726 | 2/1907 | Hunter . | |
| 870,752 | 11/1907 | White . | |
| 2,135,389 | 11/1938 | Dempsey | 52/155 |
| 3,606,222 | 9/1971 | Howard | 52/165 |
| 4,271,646 | 6/1981 | Mills . | |
| 4,644,713 | 2/1987 | Lehman . | |
| 4,756,332 | 5/1979 | Thompson . | |

*Primary Examiner*—Michael Safavi

*Attorney, Agent, or Firm*—Harpman & Harpman

[57] ABSTRACT

A post and anchoring device that rapidly secures a wooden post to the ground. An anchor stake is driven into the ground to a predetermined depth onto which a wooden post having an appeal bore is insertively engaged and locked to the anchor stake.

2 Claims, 1 Drawing Sheet

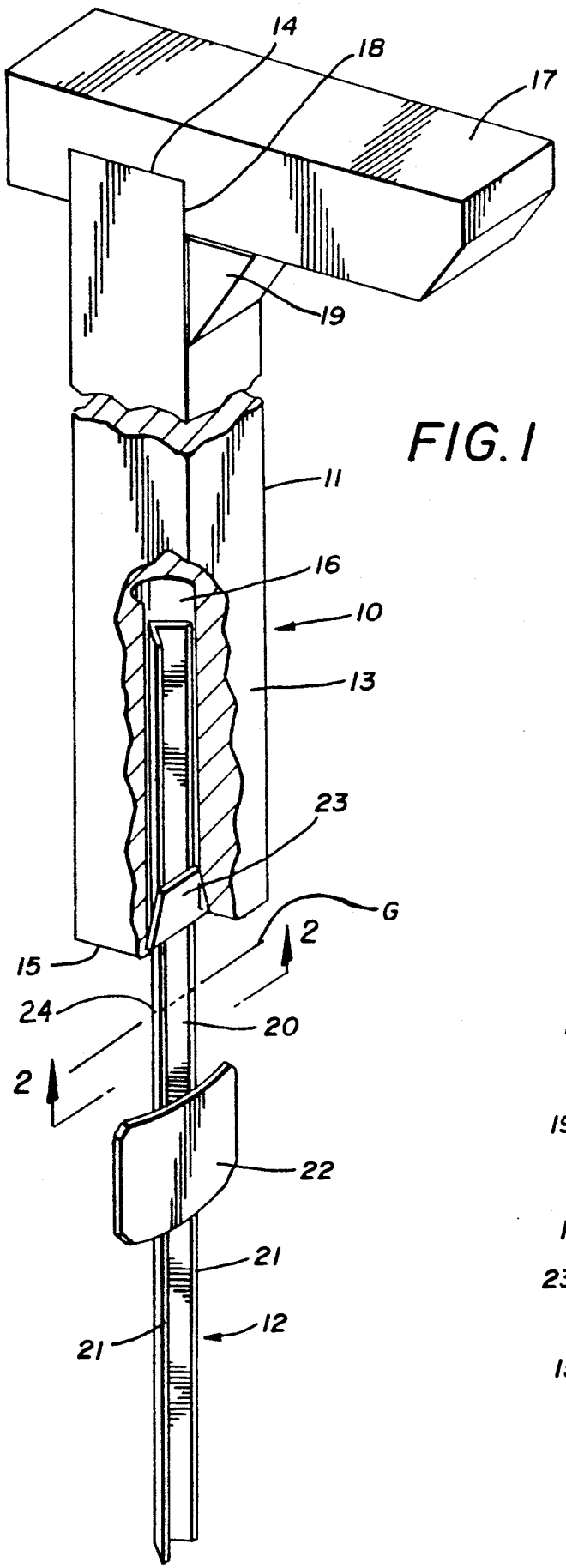
FIG. 1
FIG. 2
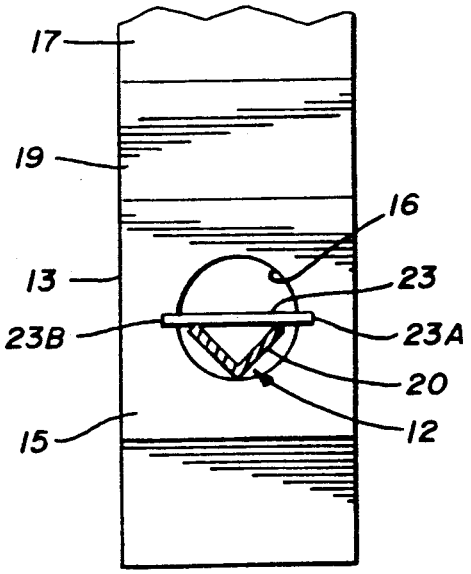

POST AND ANCHORING DEVICE

BACKGROUND OF THE INVENTION

1. Technical Field

This device relates to post anchoring systems that are used to mount a post in the ground by use of separate anchored structures.

2. Description of the Prior Art

Prior art devices of this type have relied on a number of different structural configurations to mount posts in the ground—see for example U.S. Pat. Nos. 427,815; 4,156,332; 844,726; 870,752; 4,271,646; and applicant's U.S. Pat. No. 4,644,713.

In U.S. Pat. No. 427,815 a bottom for fence posts is disclosed having a U-shaped channel upper portion and a cross sectionally T-shaped lower portion that is driven into the ground. A post is bolted within the channel portion with the post resting on the lower portion.

In U.S. Pat. No. 4,156,332 a post assembly is disclosed having a stake portion and a post support platfrom with an upstanding angular member thereon. An alternate form of the invention discloses a pair of oppositely disposed apertured plates with intrically formed downturned extending ground engaging angles.

U.S. Pat. No. 844,726 discloses a fence post setting tool having a hollow pointed stake portion with a post receiving socket formed on the opposite end.

In U.S. Pat. No. 870,752 a clothes line prop is disclosed wherein a cylindrical socket having a back plate and side flanges as shown.

U.S. Pat. No. 4,271,646 discloses a post support means having a stake formed of crossed angular members and a post receiving socket on one end thereof.

In applicant's own U.S. Pat. No. 4,644,713 a post anchor device is disclosed which utilizes a hollow stake configuration with an upstanding bracket into which the bottom of the post is positioned and then secured.

SUMMARY OF THE INVENTION

A post and anchor device to rapidly position and support a post in the ground. the post and anchor device is comprised of an anchor stake having an elongated angle configuration with a ground support element and a post engaging element positioned in spaced relation thereon. The anchor stake is driven into the ground and is then wedgeably engaged in an axial bore of a post positioned over the anchor stake providing a secure upright mounting of the post.

DESCRIPTION OF THE DRAWINGS

FIG. 1 is a prospective view of the post and anchor stake device with portions broken away.

FIG. 2 is a sectional view on lines 2—2 of FIG. 1.

DESCRIPTION OF THE PREFERRED EMBODIMENT

A post and anchoring device 10 can be seen in FIG. 1 of the drawings comprising a post assembly 11 and an anchor stake 12.

The post assembly is comprised of a main vertically aligned solid wood post 13 having a top end portion 14 and an oppositely disposed free end portion 15 thereon.

A centrally aligned bore extends inwardly from said free end portion 15 at 16.

A horizontally disposed cross member 17 is secured on and extends from said top end portion 14 of the main post 13. The cross member 17 is notched transversally in spaced relation to its free end at 18 for receiving engagement with said top end portion 14 of the main post 13 as will be understood by those skilled in the art.

A cross sectionally triangular shaped corner support 19 is secured by fasteners (not shown) at the intersection of the herein before described main post 13 and the cross member 17 for additional support thereto.

Referring now to FIGS. 1 and 2 of the drawings the anchor stake 12 can be seen comprising an elongated angle bar 20 having spaced parallel angular edges 21. A ground engaging anchor plate 22 is secured across the edges 21 midway along said angle bar 20.

The ground anchor plate 22 extends beyond said edges 21 providing an increased ground engagement characterized by such well known structures within the art. A post anchor plate 23 is secured to the angle bar 20 across and beyond the edges 21 in longitudinally spaced relation to said ground anchor plate 22.

The post anchor plate 23 has tapered oppositely disposed sides 23A and 23B angled outwardly from said angle bar 20 towards said ground anchor plate 22.

In use the post and anchor device can be seen with the anchor stake 12 driven into the ground G to a depth that falls just midway between said post and ground anchor plates 22 and 23 respectively. The mounting post 13 with its central bore at 16 is driven down over said upstanding portion of said anchor stake 12, achieving a friction fit between said post 13, anchor stake 12, and anchor plate 23. The post anchor plate 23 with its tapered sides 23A and 23B is driven into wedging engagement within said bore at 16 impinging into the main post 13 beyond the confines of the bore at 16. The wedging action of said post anchor plate 23 securely fastens the post assembly 11 on to the anchor stake in a vertical upstanding position.

Referring to FIG. 1 of the drawings a depth indicator coating is shown at 24 in which a colored coating is applied to the anchor stake 12 including the ground anchor plate 22. This depth coating indicator 24 is used to guide the user to the proper depth that the stake 12 should be driven in the ground.

It will thus be seen that a new and novel post and anchor device has been illustrated and described and that various changes and modifications may be made therein without departing from the spirit of the invention,

What I claim is:

1. A post and anchor device to secure a post to the ground comprising: a post assembly and an anchor stake, said post assembly consisting of a main post of a known length having an axial bore inwardly of one end, said anchor stake comprising an elongated angle bar of known length and width having at least one post anchor of a width greater than said angle bar and said bore secured thereto, means for securing said angle bar in the ground at a predetermined depth, and means for securing said angle bar within said axial bore in said post, said means for securing said angle bar within said bore in said post comprising said post anchor on said angle bar engaged within said bore in said post, said post anchor being a plate having a lengthwise dimension greater than that of said known width of said angle bar and said bore in said post for wedgeably securing said post anchor plate within said post.

2. The post and anchor device of claim 1 wherein said main post is wood.

* * * * *